US007300735B2

(12) United States Patent
Tsurumi et al.

(10) Patent No.: US 7,300,735 B2
(45) Date of Patent: Nov. 27, 2007

(54) ELECTROPHOTOGRAPHIC TONER AND PRODUCTION METHOD THEREFOR

(75) Inventors: Yosuke Tsurumi, Kanagawa (JP); Hiroshi Nakazawa, Kanagawa (JP); Kazufumi Tomita, Kanagawa (JP); Shuji Sato, Kanagawa (JP); Akira Matsumoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 479 days.

(21) Appl. No.: 10/929,678

(22) Filed: Aug. 31, 2004

(65) Prior Publication Data

US 2005/0175920 A1 Aug. 11, 2005

(30) Foreign Application Priority Data

Feb. 10, 2004 (JP) ..... 2004-033214

(51) Int. Cl.
*G03G 9/08* (2006.01)

(52) U.S. Cl. ..... 430/108.8; 430/110.1; 430/110.3; 430/111.4

(58) Field of Classification Search ..... 430/108.8, 430/110.1, 110.3, 111.4
See application file for complete search history.

(56) References Cited

U.S. PATENT DOCUMENTS

| | | | | |
|---|---|---|---|---|
| 3,974,078 | A * | 8/1976 | Crystal | 430/110.2 |
| 6,677,097 | B2 * | 1/2004 | Ohmura et al. | 430/110.3 |
| 6,899,985 | B2 * | 5/2005 | Inoue et al. | 430/108.8 |
| 6,924,073 | B2 * | 8/2005 | Higuchi et al. | 430/108.4 |
| 7,186,492 | B2 * | 3/2007 | Hayashi et al. | 430/108.4 |
| 2003/0175611 | A1 * | 9/2003 | Fujii et al. | 430/124 |
| 2004/0121256 | A1 * | 6/2004 | Suzuki et al. | 430/109.4 |

FOREIGN PATENT DOCUMENTS

| | | |
|---|---|---|
| JP | A 63-282752 | 11/1988 |
| JP | A 2-105163 | 4/1990 |
| JP | A 5-61239 | 3/1993 |
| JP | A 6-250439 | 9/1994 |
| JP | A 9-73187 | 3/1997 |
| JP | A 10-161338 | 6/1998 |
| WO | WO 03/0087949 A * | 10/2003 |

OTHER PUBLICATIONS

English language machine translation of JP 10-161338 (Jun. 1998).*
English language machine translation of JP 09-073187 (Mar. 1997).*
JIS K 7121, Testing Methods for Transition Temperatures of Plastics. (1987) pp. 1-9.*

* cited by examiner

*Primary Examiner*—Christopher RoDee
(74) *Attorney, Agent, or Firm*—Oliff & Berridge, PLC

(57) ABSTRACT

An electrophotographic toner contains a resin, a colorant and a releasing agent. The releasing agent has a solidifying point of from 79° C. to 109° C., and one peak in an endothermic curve measured by a differential scanning calorimeter. A difference between temperature to give a maximum endothermic peak of the releasing agent and an end-set temperature of the releasing agent is within 10° C. A melt viscosity of the releasing agent at 110° C. is in a range of from 4 mPa·s to 9 mPa·s. The releasing agent in one particle of the toner forms 3 or more domains. Domains having a ratio of a major axis to a minor axis which is in a range of from 5 to 15 occupy 90% or more by number based on the total number of domains.

7 Claims, No Drawings

ELECTROPHOTOGRAPHIC TONER AND PRODUCTION METHOD THEREFOR

BACKGROUND OF THE INVENTION

1. Field of the Invention

The present invention relates to a toner for an electrostatic charge development for use in an electrophotography and a method for producing the toner.

2. Description of the Related Art

An image forming method for visualizing image information via an electrostatic charge image by an electrophotographic method is now utilized in various fields. In recent years, with development of digitalization or a high-grade image processing technique, a technique for obtaining a higher quality image has been required.

Regarding such requirement for the high quality image, It has been in progress to bring the toner for the electrostatic charge development into that having a small size and a uniform particle size distribution. In a conventional knead-grinding method, there is a limitation in bring it into that having the small size. With reference to bring it into that having the uniform particle size distribution, even when the toner is allowed to pass through a classification step, it can not sufficiently be responded to bring the image into that having a high quality.

Further, a consideration to the environment, a low energy consumption, a low cost and a long period of life time are required for the toner for the electrostatic charge development. As measures for attaining these features, from the standpoint of a fixation technique, oilless fixing for the long period of life time, and a low-temperature high-speed fixation for the low energy consumption and the low cost can be mentioned. As for methods for attaining these measures, a method in which a releasing agent such as a wax is contained in the toner such that the toner itself has a releasing effect has ordinarily been performed.

However, it is a present situation in which, in the conventional knead-grinding method, it is difficult to control a structure of the releasing agent and control an amount to be added in a same manner as in the case of bringing the toner into that having a high quality. Accordingly, the aforementioned measures hardly become practical attaining measures.

In recent years, as a method for actively controlling a structure of the toner for the electrostatic charge development, JP-A-63-282752 and JP-A-6-250439 have proposed a method for producing a toner by an emulsion-polymerization-aggregation method. In JP-A-63-282752 and JP-A-6-250439, a production method of a toner in which a resin dispersion liquid is prepared by an emulsion-polymerization method, a colorant dispersion liquid in which an colorant is dispersed in a solvent is prepared and, then, both dispersion liquids are mixed to form an aggregate having a particle diameter corresponding to that of the toner and, thereafter, the thus-formed aggregate is heated, to thereby be coalesced. In this method, a shape can be controlled to some extent and improvements of a charging property and durability can be attained. However, since an inner structure of the toner becomes approximately uniform, there remain problems in a releasing property of a fixing sheet at the time of fixing and a fixing property under a low-temperature high-speed condition.

Then, in JP-A-5-61239, a toner for oilless fixing which contains a large amount of releasing agent component in the toner has been proposed. However, when a large amount of releasing agent is added, although a releasing property is improved to some extent, a binder component and the releasing agent exhibit compatibility therebetween and, then, oozing of the releasing agent can not stably and uniformly be performed and, accordingly, a releasing stability can not be obtained. Further, dispersibility of each material inside the toner comprehensively affects fixing properties to a great extent, such as, an adhesion property of the aforementioned fixed image to paper, a releasing property from a fixing roll, a folding resistance after the fixing, a gloss and an OHP transparency.

As for methods for improving dispersibility of the releasing agent, for example, in JP-A-2-105163, a method in which a property to be contained and an oozing property of the releasing agent are both improved by actively incorporating a resin having a polar group has been proposed. However, although this method has improved the oozing property and the property of containing the releasing agent to some extent, little effect in controlling a position of the releasing agent within the toner or improving dispersibility of the colorant is obtained and, as a result, the fixing property can not fully be improved.

Further, in JP-A-9-073187 and JP-A-10-161338, focusing on a structure of a releasing agent in a toner, the toner in which a ratio of a major axis to a minor axis of a wax in the toner is defined has been described. Although such method as described in JP-A-9-073187 and JP-A-10-161338 has improved an oozing property of the releasing agent at the time of fixing to some extent in a same manner as in the case described above and improved a fixing performance, there is little effect in efficiency and an oozing speed and, also, there is no description on thermal characteristics of the releasing agent. Accordingly, it is difficult to sufficiently correspond to the low-temperature high-speed fixing or the oilless fixing.

SUMMARY OF THE INVENTION

The present invention has been made in view of the above circumstances to provide an electrophotographic toner which solves the aforementioned problems and a method for producing the toner. Namely, an purpose of the present invention is to provide an electrophotographic toner which has an excellent releasing property in oilless fixing and shows excellent performances in high-speed fixing and low-temperature fixing and a method for producing the toner.

According to a first aspect of the invention, An electrophotographic toner includes a resin, a colorant and a releasing agent. In the electrophotographic toner, the releasing agent has a solidifying point of from 79° C. to 109° C., the releasing agent has one peak in an endothermic curve measured by a differential scanning calorimeter, a difference between a temperature to give a maximum endothermic peak of the releasing agent and an end-set temperature of the releasing agent is within 10° C., a melt viscosity of the releasing agent at 110° C. is in a range of from 4 mPa·s to 9 mPa·s. The releasing agent in one particle of the toner forms 3 or more domains. The domains include domains having a ratio of a major axis to a minor axis in a range of from 5 to 15 which occupy equal to or more than 90% by number based on the total number of domains. The domains include domains having a major axis of 1.5 μm or more which occupy equal to or more than 40% by number based on the total number of domains, and the domains include domains having 1.0 μm or more which occupy equal to or more than 80% by number based on the total number of domains.

According to a second aspect of the invention, a method for producing an electrophotographic toner including a resin, a colorant and a releasing agent, includes preparing aggregated-particles by a metallic ion from a resin particle, a colorant particle and a releasing agent particle which are dispersed in water by using a surfactant and thermally fusing the aggregated-particles. In the method, the releasing agent has a solidifying point of from 79° C. to 109° C., the releasing agent has one peak in an endothermic curve measured by a differential scanning calorimeter, a difference between a temperature to give a maximum endothermic peak of the releasing agent and an end-set temperature of the releasing agent is within 10° C., and a melt viscosity of the releasing agent at 110° C. is in a range of from 4 mPa·s to 9 mPa·s. The releasing agent in one particle of the toner forms 3 or more domains. The domains include domains having a ratio of a major axis to a minor axis in a range of from 5 to 15 which occupy equal to or more than 90% by number based on the total number of domains. The domains include domains having a major axis of 1.5 μm or more which occupy equal to or more than 40% by number based on the total number of domains, and the domains include domains having 1.0 μm or more which occupy equal to or more than 80% by number based on the total number of domains.

A toner according to the present invention has, in oilless fixing, an excellent offset resistance and a high releasing performance and can stably form an high quality image having no image deficit for a long period of time.

DETAILED DESCRIPTION OF THE PREFERRED EMBODIMENTS

Hereinafter, an electrophotographic toner according to the present invention and a method for producing the toner will be described in detail.

A resin or a resin particle to be used in the present invention is not particularly limited. A resin particle dispersion liquid containing an ionic surfactant, ordinarily prepared by such as an emulsion-polymerization method is used. The resin particle dispersion liquid is mixed with a colorant particle dispersion liquid and a releasing agent particle dispersion liquid. Then, by allowing the resultant mixed dispersion liquid to perform a hetero aggregation by another ionic surfactant having a polarity opposite to that of the aforementioned ionic surfactant, an aggregated particle having a diameter identical to that of the toner is formed. Thereafter, the thus-formed aggregated particle is coalesced by heating to temperature which is a glass transition point or higher of the resin particle, then rinsed and dried, thereby obtaining a toner. Further, as for shapes of the toner, any shape of from an amorphous one to a spherical one can favorably be used.

Further, it is also favorable to obtain the toner by a method to be described below. In an early stage in which the resin particle dispersion liquid, the colorant particle dispersion liquid and the releasing agent dispersion liquid are mixed, a balance of volumes of ionic dispersants thereof having each polarities is allowed to be biased in advance. Then, the resultant mixture is ionically neutralized by adding a polymer of an inorganic metallic salt such as polychlorinated aluminum and, thereafter, heated to a temperature of a glass transition point or lower to form a fist stage mother aggregated particle and, then, stabilized. It is also permissible that, as a second stage, the resultant mixture is added with the resin particle dispersion liquid treated by an ionic dispersion liquid having such polarity and amount as offsets the bias of the ionic balance and, optionally, slightly heated at a temperature of a glass transition point or lower of a resin contained in the resin particle in the mother aggregated particle and thus-added resin particle and, then, heated at a further elevated temperature to be stabilized and, thereafter, the particle added in the second stage of aggregation forming is allowed to be adhered to a surface of the mother aggregated particle and coalesced therewith in such adhered state by heating at a temperature of glass transition point or higher. Further, such operations as described above of aggregation stages may be repeated a plurality of times. Such two-stage aggregation method as described above is effective in improving properties to be contained of the releasing agent and the colorant.

A large variety of polymers can be used as the resin or resin particle to be used in the present invention and the polymers are not particularly limited; however, homopolymers or copolymers of ethylenic unsaturated monomer containing a vinyl-type monomer are favorably used. Examples of monomers constituting the homopolymers or copolymers include styrenes such as styrene, p-chlorostyrene and α-methylstyrene; (meth)acrylic acid esters such as methyl acrylate, ethyl acrylate, n-propyl acrylate, n-butyl acrylate, lauryl acrylate, 2-ethylhexylacrylate, methylmethacrylate, ethylmethacrylate, n-propyl methacrylate, lauryl methacrylate and 2-ethylhexyl methacrylate; ethylenic unsaturated nitriles such as acrylonitrile and methacrylonitrile; ethylenic unsaturated carboxylic acids such as acrylic acid, methacrylic acid and crotonic acid; vinyl ethers such as vinyl methyl ether and vinyl isobutyl ether; vinyl ketones such as vinyl methyl ketone, vinyl ethyl ketone and vinyl isopropenyl ketone; olefins such as ethylene, propylene and butadiene; and β-carboxyethyl acrylate. The homopolymers comprising any one type of these monomers, the copolymers comprising any two types or more of these monomers may be used each individually or in combinations. Further, an epoxy resin, a polyester resin, a polyurethane resin, a polyamide resin, a cellulose resin, a polyether resin, a non-vinyl condensed-type resin, a mixture of any one of these resins and the aforementioned ethylenic unsaturated addition-polymer resin, a graft polymer obtained by polymerizing any one of the ethylenic unsaturated monomer under a coexistence of any one of these resins, and the like are also mentioned.

The resin to be used in the toner according to the present invention can be produced by a radical polymerization of a polymerizable monomer.

Initiators for radical polymerization to be used in the present invention are not particularly limited. Specific examples thereof include peroxides such as hydrogen peroxide, acetyl peroxide, cumyl peroxide, t-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate (ammonium peroxodisulfate), sodium persulfate, potassium persulfate, diisopropyl peroxycarbonate, tetralin hydroperoxide, 1-phenyl-2-methyl propyl-1-hydroperoxide, tert-butyl triphenyl peracetate hydroperoxide, tert-butyl performate, tert-butyl peracetate, tert-butyl perbenzoate, tert-butyl phenyl peracetate, tert-butyl methoxyperaceate and tert-butyl N-(3-toluyl)percarbamate.

Further examples thereof include azo compounds such as 2,2'-azobispropane, 2,2'-dichloro-2,2'-azobispropane, 1,1'-azo(methylethyl)diacetate, 2,2'-azobis(2-amidinopropane) hydrochloride, 2,2'-azobis(2-amidinopropane)nitrate, 2,2'-azobisisobutane, 2,2'-azobisisobutylamide, 2,2'-azobisisobutylonitrile, methyl 2,2'-azobis-2-methyl propionate, 2,2'-dichloro-2,2'-azobisbutane, 2,2'-azobis-2-methyl butylonitrile, dimethyl 2,2'-azobisisobutyrate, 1,1'-azobis(sodium 1-methyl butylonitrile-3-sulfonate), 2-(4-methyl phenylazo)-2-methyl malonodinitrile, 4,4'-azobis-4-cyanovaleric acid, 3,5-dihydroxymethyl phenylazo-2-methyl malonodinitrile, 2-(4-boromophenylazo)-2-allyl malononitrile, 2,2'-azobis-2-methyl valeronitrile, dimethyl 4,4'-azobis-4-cyanovalerate, 2,2'-azobis-2,4-dimethyl valeronitrile, 1,1'-azobiscyclohexane nitrile, 2,2'-azobis-2-propyl butylonitrile, 1,1'-azobis-1-chlorophenyl ethane, 1,1'-azobis-1-cyclohexane carbonitrile, 1,1'-azobis-1-cycloheptane nitrile, 1,1'-azobis-1-phenyl ethane, 1,1'-azobiscumene, ethyl 4-nitrophenylazobenzyl cyanoacetate, phenylazodiphenyl methane, phenylazotriphenyl methane, 4-nitrophenylazotriphenyl methane, 1,1'-azobis-1,2-diphenyl ethane, poly(bisphenol A-4,4'-azobis-4-cyanopentanoate) and poly(tetraethylene glycol-2,2'-azobisisobutyrate); 1,4-Bis(pentaethylene)-2-tetrazene and 1,4-dimethoxycarbonyl-1,4-diphenyl-2-tetrazene.

Chain transfer agents to be used in the present invention are not particularly limited so far as they have an absorption in the wavelength range of from 500 $cm^{-1}$ to 800 $cm^{-1}$. Specifically, those having a covalent bond between a carbon atom and a sulfur atom are preferred. Examples thereof include n-alkyl mercaptans such as n-propyl mercaptan, n-butyl mercaptan, n-amyl mercaptan, n-hexyl mercaptan, n-heptyl mercaptan, n-octyl mercaptan, n-nonyl mercaptan and n-decyl mercaptan; branched chain-type alkyl mercaptans such as isopropyl mercaptan, isobutyl mercaptan, s-butyl mercaptan, t-butyl mercaptan, cyclohexyl mercaptan, t-hexadecyl mercaptan, t-lauryl mercaptan, t-nonyl mercaptan, t-octyl mercaptan and t-tetradecyl mercaptan; and aromatic ring containing-type mercaptans such as an aryl mercaptan, 3-phenyl propyl mercaptan, phenyl mercaptan and mercaptotriphenyl methane.

Among these mercaptans, n-alkyl mercaptans, branched chain-type mercaptans or aromatic ring containing-type mercaptans each having preferably 4 or more carbon atoms, more preferably 6 or more carbon atoms, further more preferably 8 or more carbon atoms are preferred. The reason to be considered is that, with increase of carbon atoms, compatibility between any one of the mercaptans and any one of other polymerizable monomers is enhanced and also polymerization reaction can stably be performed.

When the ethylenic unsaturated monomer is polymerized, the resin particle dispersion liquid can be prepared by performing an emulsion polymerization by using an ionic surfactant or the like. Further, in a case of other resins, when these resins are oily and soluble in a solvent having a comparatively low solubility in water, these resins are dissolved in the solvent and, then, are dispersed in water as a fine particle together with an ionic surfactant or a polymeric electrolyte by a dispersing apparatus such as a homogenizer and, then, the solvent is evaporated by heating or reducing a pressure, to thereby preparing the resin fine particle dispersion liquid. A particle diameter of the resin particle in the dispersion liquid can be measured by a laser diffraction-type particle size distribution measuring apparatus LA-700 (produced by Horiba, Ltd.)

In the releasing agent usable in the present invention, a solidifying point defined by ASTM D938 is preferably in a range of from 79° C. to 109° C. and more preferably in a range of from 84° C. to 100° C. When the solidifying point is less than 79° C., an offset phenomenon tends to occur at the time of fixing and, further, a glass transition point is decreased to impair image resistance such as storability and document offset resistance. Whereas, when it is more than 109° C., an oozing property of the releasing agent at the time of fixing comes to be deteriorated, thereby sometimes causing decrease of the releasing property at the time of oilless fixing.

Further, the releasing agent to be used in the present invention has one peak in an endothermic curve measured by a differential scanning calorimeter, and a difference between a temperature to give a maximum endothermic peak and an endset temperature is within 10° C. and preferably within 5° C. When there are two peaks in the endothermic curve, oozing out of the releasing agent can not be performed in a short period of time at the time of fixing. When the difference between the temperature to give the maximum endothermic peak and the endset temperature is more than 10° C., an end point of melting is not explicit to deteriorate an oilless fixing property and a high-speed low-temperature fixing property. A measurement of the aforementioned endothermic curve is performed by using a differential scanning calorimeter DSC-7 manufactured by Perkin-Elmer Corp. A temperature correction in a detecting portion of such apparatus as described above is performed by utilizing melting points of indium and zinc while a calorie correction is performed by utilizing melting heat of indium. A sample is placed on a pan made of aluminum and a vacant pan is set for comparison purpose and, then, both are subjected to measurement at a temperature-raising rate of 10° C./min.

The term "endset temperature" as used herein is a temperature at an intersecting point between a tangential line of a curve at a point at which a differential value of the endothermic curve becomes minimal and a base line. The term "onset temperature" as used herein is a temperature at an intersecting point between a tangential line of a curve at a point at which a differential value of the endothermic curve becomes maximum and a base line.

Specific materials to be used as the releasing agents are as follows: low molecular weight polyolefin-type waxes such as polyethylene, polypropylene, polybutene and the like; silicones each having a point of softening upon heating; fatty acid amides such as oleic amide, erucic amide, ricinolic amide, stearic amide and the like; vegetable-based waxes such as carnauba wax, rice wax, candelilla wax, haze wax, jojoba oil and the like; animal-based waxes such as beeswax and the like; mineral- or petroleum-type waxes such as montan wax, ozokerite, ceresin, paraffin wax, microcrystalline wax, Fischer-Tropsch wax and the like; and modified articles thereof.

As for the releasing agents, the paraffin-type waxes or the polyolefin-type waxes can favorably be used.

Among the paraffin-type waxes, a paraffin-type wax in which a ratio of isoparaffin to n-paraffin is from 4 to 10% by weight and a penetration degree at 25° C. is 5 or less is favorably used. When the ratio of isoparaffin is in such range as described above, crystallinity of the wax becomes appropriate and a difference in solidifying speed between a resin and the wax after fixing is small, thereby obtaining a favorable image surface. Further, a melting property at the time of fixing becomes favorable and, then, the releasing property in the oilless fixing is improved. When the penetration degree is 5 or less, toughness of the toner is favorable.

The ratio of isoparaffin to n-paraffin in the paraffin-type wax can quantitatively analyzed by a gas-chromatography in accordance with an ordinarily-performed method. For example, GC-17A manufactured by Shimadzu Corp. (column: liquid phase: polycarborane-polysiloxane; film thickness: 0.1 μm; inner diameter by length: 0.25 mm by 15 mm) can be utilized. As for a detector, an FID is used.

Further, the term "penetration degree" as used herein is intended to mean that measured in accordance with JIS K-2235.

A melt viscosity of the releasing agent to be used in the present invention is from 4 mPa·s to 9 mPa·s at 110° C. In a case in which the melt viscosity is less than 4 mPa·s, when the releasing agent is thermally fused at the time of producing the toner, the viscosity of the thus-melted releasing agent becomes extreamly low and, accordingly, it becomes difficult to control a structure of the releasing agent in the toner. While, in another case in which the melt viscosity is more than 9 mPa·s, the oozing speed at the time of fixing becomes slow, thereby deteriorating a low-temperature fixing property.

Further, in the releasing agent, a ratio between a melt viscosity of the releasing agent and a melt viscosity of the resin is preferably from $1.0\times10^{-4}$ to $3.0\times10^{-4}$. In such range as described above, the ratio between such viscosities of the releasing agent and resin is appropriate, oozing of the releasing agent onto an image surface becomes favorable and, accordingly, more favorable fixing performance can be obtained.

The viscosity of the releasing agent to be used in the present invention at 110° C. can be measured by using an E-type viscometer. At the time of such measurement, the E-type viscometer (manufactured by Tokyo keiki ltd.) provided with an oil circulating-type thermostat and a cone plate is used. The cone plate uses a cone angle of 1.34°. A sample is filled in a cup, a temperature of a circulating apparatus is set at 110° C., a vacant measuring cup and the cone are set in a measuring apparatus and held at a constant temperature while circulating oil. When the temperature is stabilized, 1 g of sample is filled in the measuring cup and, then, the cone is allowed to stand for 10 minutes in a standstill condition. After being stabilized, the cone is rotated to perform a measurement. A rotating speed of the cone is set at 60 rpm. Such measurements are performed three times and, then, an average of the resultant values is defined as the viscosity.

The viscosity of the resin and the viscosity of the releasing agent are measured at 180° C. under the same conditions as described above.

The releasing agent is allowed to be dispersed in water together with an ionic surfactant or a polymeric electrolyte such as a polymeric acid or a polymeric base and, then, changed into a particle by being applied with a strong shearing force by a homogenizer or a pressure discharging-type dispersing apparatus, while being heated to a melting point or higher, thereby preparing a dispersion liquid having a releasing agent particle of 1 μm or less. A particle diameter of the releasing agent particle in the dispersion liquid can be measured by using a laser diffraction-type particle size distribution measuring apparatus LA-700 (manufactured by Horiba, Co., Ltd.)

In the toner according to the present invention, an observation by a transmission electron microscope (TEM) reveals that the releasing agent is unevenly distributed in the toner particle and individual toner particles each have 3 or more domains (regions). In a case in which there are 2 or less domains in the releasing agent per one toner particle, the releasing agent is not easily oozed at the time of fixing, thereby deteriorating the fixing property.

When a cross-section of the toner particle is observed by the transmission electron microscope, it is found that a releasing agent phase and a colorant phase are each present in a continuous phase comprising a resin as an independent domain. According to the TEM observation, the toner particle is contain-embedded and, then, hardened and, thereafter, cut into a thin leaf, which is to be a sample, by using a microtome and, subsequently, a tomogram feature thereof is photographed. When the thus-photographed tomogram feature is subjected to an image analysis by using an image processing apparatus connected to the TEM, shapes and number of each of the domains and a shape factor of the toner can be determined. Values thereof can be obtained by measuring 500 particles at random.

In the toner according to the present invention, it is preferable that domains of the releasing agent in the toner particle having a ratio of a major axis to a minor axis of from 5 to 15 occupy 90% or more by number based on the total number of domains, domains having a major axis of 1.5 μm or more occupy 40% or more by number based on the total number of domains, and the domains having a major axis of 1.0 μm or more occupy 80% or more by number based on the total number of domains. When the ratio of the major axis to the minor axis of the domains of the releasing agent is less than 5, the shape of the releasing agent comes close to a sphere, thereby deteriorating oozing at the time of fixing. Such trend as described above is conspicuous particularly in the case of high-speed fixing. Further, when the ratio of the major axis to the minor axis thereof is more than 15, unevenness of fixing occurs. When domains having a major axis of 1.5 μm or more occupy less than 40% by number based on the total number of domains and, further that having a major axis of 1.0 μm or more occupy less than 80% by number based on the total number of domains, a distribution of smaller releasing agent is increased in the toner, thereby deteriorating oozing at the time of fixing and, furthermore, deteriorating a fixing performance.

The releasing agent according to the present invention is preferably contained in the electrophotographic toner, in a range of from 5 to 13% by weight based on the solid content of the toner. When the releasing agent is present in this range, the fixing performance at the time of oilless fixing is enhanced; therefore, this range is preferred. Further, more preferred range is from 6 to 11% by weight.

An acid value of the toner according to the present invention is important for the reason of not only enhancing and stabilizing a property of containing the releasing agent particle and the colorant particle in the toner, but also relating with a charging property. The acid value is preferably in a range of from 10 mg-KOH/g to 50 mg-KOH/g. When the acid value is in the aforementioned range, the property of containing them in the toner is enhanced and stabilized and, also, an appropriate charging property can be obtained. Further, since a component which imparts the acid value is in an appropriate amount and does not generate a cross-linking structure, a favorable fixing property can be obtained.

In the toner according to the present invention, the volume average particle diameter D50v is preferably in a range of from 3 μm to 9 μm. The volume average particle size distribution index GSDv (D84v/D16v) is preferably 1.30 or less. Furthermore, a ratio of the volume average particle size distribution index GSDV to a number average particle size distribution index GSDp (GSDv/GSDp) is preferably 0.95 or more. In any of such cases as described above, the toner for the electrostatic charge development which can form an image excellent in fineness of image quality can be provided. A preferred range of D50v is of from 4 μm to 8 μm, while that of GSDv is of from 1.0 to 1.28, and GSDv/GSDp is of from 0.95 to 1.2. When the volume average particle diameter D50v of the toner according to the present invention is in the aforementioned range, the charging property of the toner becomes appropriate and, then, a favorable developing property and a high resolution can be obtained. When the ratio of the volume average particle size distribution index to the number average particle size distribution index (GSDv/GSDp) is in the aforementioned range, a favorable charging property can be obtained and scattering of the toner and an image deficit such as fogging are not generated; therefore, these ranges are favorable.

The volume average particle diameter, the volume average particle size distribution index and the number average particle size distribution index of the toner according to the present invention can be measured by using a measuring apparatus such as a Coulter counter TA-II (produced by Beckmann-Coulter Co., Ltd.) or a Multisizer II (produced by Beckmann-Coulter Co., Ltd.). Namely, as for the particle size distribution, the particle size is divided into a plurality of ranges (channels). In regard to volume and number, a cumulative distribution curve of each of volume and number in divided particle size ranges (channels) is constructed starting from the side of smaller diameter and, thereafter, the particle diameter which shows 16% of accumulation is defined as the volume average particle diameter D16v and the number average particle diameter D16p; and that showing 84% of accumulation is defined as the volume average particle diameter D84v and the number average particle diameter D84p. While using these values, the volume average particle size distribution index GSDv is determined based on D84v/D16v; and the number average particle size distribution index GSDp is determined based on D84p/D16p.

Further, by setting the shape factor SF1 of the toner according to the present invention in a range of from 110 to 140, the toner for the electrostatic charge development which is excellent in a developing property and a transferring property can be provided and, accordingly, such setting is preferred. A preferred range of the shape factor SF1 is from 125 to 138. The shape factor SF1 is an average value which is determined by the method as described below. The toner is spread on a slide glass and an optical microscopic image of the thus-spread toner is taken in a Luzex image analyzing apparatus via a video camera. Thereafter, a peripheral length and a projected area of 50 or more particles are measured. Based on the thus-measured peripheral length and projected area, SF1 is determined by the following formula, whereby an average value thereof is obtained:

$$SF1=(ML)^2/A\times(100/4\pi),$$

In the formula, ML represents a peripheral length of a toner particle and A represents a projected area of the particle.

A charged amount of the toner for the electrostatic charge development according to the present invention is preferably in a range of from 20 μC/g to 80 μC/g as the absolute value and more preferably in a range of from 25 μC/g to 35 μC/g. When the charged amount is in these ranges, a background strain (fogging) is hard to occur and a favorable image density can be obtained and, accordingly, these ranges are favorable. A ratio of the charged amount of the toner for the electrostatic charge development in summer (high temperature, high humidity) to that in winter (low temperature, low humidity) is preferably in a range of from 0.5 to 1.5 and more preferably in a range of from 0.7 to 1.3. In a case in which the ratio is in these ranges, the environmental reliance of the charging property becomes low and the stability of charging is favorable; therefore, the case is favorable.

A glass transition point of the toner according to the present invention is preferably in a range of from 49° C. to 58° C. In a case in which the glass transition point is less than 49° C., storability of the image, document offset or the like becomes deteriorated and, accordingly, the case is not favorable.

As for the colorants to be used in the present invention, known colorants can be used.

Examples of black pigments include carbon black, copper oxide, manganese dioxide, aniline black, active carbon, non-magnetic ferrite and magnetite.

Examples of yellow pigments include chrome yellow, zinc chromate, yellow iron oxide, Cadmium Yellow, Chrome Yellow, Hansa Yellow, Hansa Yellow 10G, Benzidine Yellow G, Benzidine Yellow GR, Threne Yellow, Quinoline Yellow and Permanent Yellow NCG.

Examples of orange pigments include red chrome yellow, Molybdenum Orange, Permanent Orange GTR, Pyrazolone Orange, Vulcan Orange, Benzidine Orange G, Indanthrene Brilliant Orange RK and Indanthrene Brilliant Orange GK.

Examples of red pigments include colcothar, Cadmium Red, red lead oxide, mercury sulfide, Watchung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eosine Red and Alizarine Lake.

Examples of blue pigments include Prussian Blue, Cobalt Blue, Alkaline Blue Lake, Victoria Blue Lake, Fast Sky Blue, Indanthrene Blue BC, Aniline Blue, Ultramarine Blue, Carcoil Blue, Methylene Blue Chloride, Phthalocyanine Blue, Phthalocyanine Green and Malachite Green Oxalate.

Examples of violet pigments include manganese violet, Fast Violet B and Methyl Violet Lake.

Examples of green pigments include chromium oxide, Chrome Green, Pigment Green, Malachite Green Lake and Final Yellow Green G.

Examples of white pigments include zinc flower, titanium oxide, antimony white and zinc sulfide.

Examples of extender pigments include baryte powder, barium carbonate, clay, silica, white carbon, talc and alumina white.

As for dyes, various dyes such as basic, acidic, dispersion liquid and direct dyes are permissible. Examples of such dyes as described above include nigrosin, Methylene Blue, Rose Bengal, Quinoline Yellow and Ultramarine Blue.

These colorants are used each singly, in mixtures thereof or in a state of solid solution. These colorants can be dispersed by a known method; on this occasion, a rotation sharing-type homogenizer, a media-type dispersing apparatus such as a ball mill, a sand mill or an attritor, or a high-pressure counter collision-type dispersing apparatus can favorably be used.

The colorants can be dispersed in an aqueous system by the aforementioned homogenizer using a surfactant having a polarity.

The colorant according to the invention is selected from the standpoint of a hue angle, chroma, brightness, weather resistance, an OHP transmission property, and dispersibility in the toner. An amount of the colorant to be added is preferably in a range, of from 1% by weight to 20% by weight based on the total weight of a resin in the toner. In a case in which a magnetic material is used as a black colorant, it can be added, different from the case of other colorants, in a range of from 30 to 100% by weight.

When the toner according to the present invention is used as a magnetic toner, the toner may contain a magnetic powder in a binding resin. As for such magnetic powder, a substance which is magnetized in a magnetic field is used. Specifically, a ferromagnetic powder such as that of iron, cobalt or nickel, or a compound such as ferrite or magnetite is used. Particularly, according to the present invention, in order to obtain the toner in an aqueous phase, a migration property of a magnetic material into an aqueous phase is important. It is preferred that the magnetic material has beforehand been subjected to a surface modification, for example, a hydrophobic property-imparting treatment.

According to the present invention, a charge-controlling agent can be compounded for further improving and stabilizing the charging property of the toner. As for the charge-controlling agent, various types of charge-controlling agents such as quaternary ammonium salt compounds; Nigrosine-type compounds; dyes each comprising a complex of aluminum, iron, chromium or the like; and triphenyl methane-type pigments can be used; however, from the view points of controlling an ionic strength giving an influence to stability at the time of aggregation and coalescence and reducing a waste water pollution, a material which is hard to be dissolved in water is preferred.

According to the present invention, for the purpose of stabilizing the charging property of the toner, an inorganic particle can be added in a wet state. As for such inorganic particles, all materials which are each ordinarily used as an external additive to a surface of the toner, such as silica, alumina, titania, calcium carbonate, magnesium carbonate and tri-calcium phosphate, can be used by being dispersed in an ionic surface active agent, a polymeric acid or a polymeric base.

Further, for the purposes of imparting fluidity or improving the cleaning property, after the toner is dried, an inorganic particle of silica, alumina, titania or calcium carbonate, or a resin particle of a vinylic resin, polyester or silicone is added to a surface of the toner while applying a shearing force and can, then, be used as a fluidity auxiliary or a cleaning auxiliary.

In the production method of the toner according to the present invention, as for illustrative surfactants to be used for the purpose of performing emulsion-polymerization of the resin particle, dispersion liquid of the colorant, addition-dispersion liquid of the resin particle, dispersion liquid of the releasing agent, aggregation thereof, stabilization thereof or the like, an anionic surfactant of, for example, a sulfuric acid ester salt type, a sulfonic acid salt type, a phosphoric acid ester type or a soap type; or a cationic surfactant of, for example, an amine salt type or a quaternary ammonium salt type can be used. Further, it is also effective to simultaneously use a nonionic surfactant of, for example, a polyethylene glycol type, an alkylphenol ethylene oxide adduct type or a polyhydric alcohol type. As for dispersing devices, a rotary shearing-type homogenizer, or any one of a ball mill, a sand mill, a dynomill and the like which each have a media can ordinarily be used.

According to the present invention, after coalescence is complete, a desired toner can be obtained by passing through an arbitrary rinsing step, a solid-liquid separation step and drying step. In the rinsing step, it is preferable to perform a displacement rinsing using a sufficient amount of ion-exchanged water for the purpose of generating and maintaining the charging property. Further, the solid-liquid separation step is not particularly limited; however, from the standpoint of productivity, suction filtration, press-filtration or the like is favorably used. Still further, the drying step is not particularly limited; however, from the point of productivity, freeze-drying, flash jet drying, fluid drying, vibration-type fluid drying or the like is favorably used.

EXAMPLES

Hereinafter, the present invention is described in more detail with reference to examples; however, the present invention is not limited thereto.

A toner according to the present invention is produced by a method as described below. Namely, a resin particle dispersion liquid, a colorant particle dispersion liquid and a releasing agent particle dispersion liquid as described below are each individually prepared. Then, respective predetermined amounts of the aforementioned dispersion liquids are mixed together. The resultant mixture is ionically neutralized by being added with a polymer of an inorganic metal salt with stirring, thereby forming respective aggregates of the aforementioned particles. After adjusting a pH value inside a system by using an inorganic hydroxide to be in a range of from being slightly acidic to neutral, the aggregates are heated to a temperature of glass transition point or higher of the above-described resin particles, thereby, to coalesce the aggregates. Thereafter, by allowing the-thus coalesced aggregates to pass through the steps of sufficient rinsing, solid-liquid separation and drying, a desired toner is obtained.

A preparation method of each dispersion liquid and a preparation method of each aggregated particle are specifically described below.

(Preparation of Resin Particle Dispersion) Liquid

| | |
|---|---|
| (Oil layer) | |
| Styrene (produced by Wako Pure Chemicals) | 30 parts by weight |
| n-butyl acrylate (produced by Wako Pure Chemicals) | 10 parts by weight |
| β-carboxyethyl acrylate (produced by Rhodia Nikka) | 1.3 part by weight |
| Dodecanethiol (produced by Wako Pure Chemicals) | 0.4 part by weight |
| (Water layer 1) | |
| Ion-exchanged water | 17 parts by weight |
| Anionic surfactant (trade name: DOWFAX; produced by Dow Chemical) | 0.4 part by weight |
| (Water layer 2) | |
| Ion-exchanged water | 40 parts by weight |
| Anionic surfactant (trade name: DOWFAX; produced by Dow Chemical) | 0.05 part by weight |
| Ammonium peroxodisulfate (produced by Wako Pure Chemicals) | 0.4 part by weight |

Components of the oil layer and the water layer 1 are filled in a flask and mixed with each other with stirring to prepare a monomeric emulsion-dispersion liquid. A component of the water layer 2 is filled in a reaction vessel and, then, an inside of the vessel is fully replaced with a nitrogen gas and, thereafter, heated in an oil bath with stirring such that an inside of a reaction system became 75° C. The previously prepared monomeric emulsion-dispersion liquid is gradually added in the reaction vessel in a dropping manner consuming 3 hours, to thereby perform emulsion-polymerization. After such addition in a dropping manner is complete, polymerization is allowed to further continue at 75° C. and, after 3 hours have passed, the polymerization is terminated.

When a volume average particle diameter D50v of the thus-obtained resin particles is measured by using a laser diffraction-type particle size distribution measuring apparatus (type: LA-700; produced by Horiba, Co., Ltd.), it is found to be 250 nm. When a glass transition point of the resin is measured by using a differential scanning calorimeter (type: DSC-50; produced by Shimadzu Corp.) at a temperature-raising rate of 10° C./min, it is found to be 52° C. When a number average molecular weight (in terms of polystyrene) thereof is measured by using a molecular weight measuring apparatus (type: HLC-8020; produced by Tosoh Corp.) with a solvent being THF, it is found to be 13,000. Further, a melt viscosity thereof at 180° C. is measured by using an E-type viscometer (produced by Tokimec Inc.; corn angle: 1.35° at 60 rpm), it is found to be 16 Pa·s.

Based on these measurements, it is found that the resin particle dispersion liquid having a volume average particle diameter of 250 nm, a solid content of 42%, a glass transition point of 52° C. and a number average molecular weight Mn of 13,000 is obtained.

(Preparation of Colorant Particle Dispersion Liquid)

| | |
|---|---|
| Black pigment (carbon black) (trade name: Regal 330; produced by Cabbot Corp.) | 30 pats by weight |
| Anionic surfactant (trade name: NEOGEN RK; produced by Dai-ichi Kogyo Seiyaku Co., Ltd.) | 3 parts by weight |
| Ion-exchanged water | 400 parts by weight |

These components are mixed together, dispersed by a homogenizer (trade name: ULTRATALAX; produced by IKA Werke) for 10 minutes, to thereby obtain a colorant particle dispersion liquid having a number volume average particle diameter of 120 nm and a solid content of 20%.

(Preparation of Releasing Agent Particle Dispersion Liquid 1)

| | |
|---|---|
| Releasing agent 1 | 50 parts by weight |
| Anionic surfactant (trade name: NEOGEN RK; produced by Dai-ichi Kogyo Seiyaku Co., Ltd.) | 2 parts by weight |
| Ion-exchanged water | 200 parts by weight |

These components are heated at 110° C., sufficiently dispersed by using ULTRATALAX T50 (produced by IKA) and, then, subjected to a dispersion liquid-treatment by a pressure discharging-type homogenizer, to thereby obtain a releasing agent particle dispersion liquid having a volume average particle diameter of 250 nm and a solid content of 20%.

(Preparation of Releasing Agent Particle Dispersion Liquids 2 to 7)

Releasing agent particle dispersion liquids 2 to 7 are obtained in a same manner as in that described above except that releasing agents 2 to 7 are each individually used in place of releasing agent 1 and a dispersion liquid temperature is changed. Further, in releasing agent particle dispersion liquids 2 to 7, a volume average particle diameter and a solid content are same as those in releasing agent particle dispersion liquid 1, respectively.

In Table 1, shown are the measuring results: a solidifying point; a ratio between a melt viscosity at 110° C. and that at 180° C.; an onset temperature; a temperature to give a maximum endothermic peak (peak temperature); an endset temperature; and penetration degree at 25° C. of each of releasing agents 1 to 7. Further, releasing agents 1 to 7 each had one maximum endothermic peak.

TABLE 1

| Releasing agent No. | Substance name | Dispersion liquid temperature (° C.) | Solidifying point (° C.) | Melt viscosity/110° C. (mPa · s) | DSC onset temperature (° C.) | DSC maximum endothermic peak temperature (° C.) | DSC endset temperature (° C.) | Ratio in viscosity to resin/180° C. ($\times 10^{-4}$) | Ratio of isoparaffin to n-paraffin (weight %) | Penetration degree (25° C.) |
|---|---|---|---|---|---|---|---|---|---|---|
| 1 | Paraffin wax | 110 | 89 | 6.4 | 78 | 90 | 95 | 1.75 | 7 | 3 |
| 2 | Paraffin wax | 110 | 84 | 5.9 | 64 | 85 | 90 | 1.5 | 9 | 3 |
| 3 | Polyolefin wax | 110 | 85 | 5.3 | 58 | 84 | 93 | 1.5 | — | 2 |
| 4 | Paraffin wax | 130 | 100 | 8.6 | 80 | 90 | 98 | 3.5 | 9 | 2 |
| 5 | Paraffin wax | 110 | 74 | 3.7 | 70 | 75 | 83 | 0.8 | 13 | 7 |
| 6 | Polyolefin wax | 110 | 85 | 5.8 | 63 | 87 | 107 | 1.5 | — | 2 |
| 7 | Polyolefin wax | 130 | 112 | 36*[1] (150° C.) | 100 | 114 | 118 | 15.6 | — | 1 |

*[1]Since the melting point is more than the melting viscosity, the value thereof at 150° C. is shown.

Example 1

| | |
|---|---|
| The aforementioned resin particle dispersion liquid | 150 parts by weight |
| The aforementioned colorant particle dispersion liquid | 30 parts by weight |
| The aforementioned releasing agent particle dispersion liquid | 145 parts by weight |
| Polychlorinated aluminum | 0.4 part by weight |

These components are filled in a flask with a round bottom made of stainless steel, sufficiently mix-dispersed by using ULTRATALAX T50 (produced by IKA) and, then, heated to 48° C., while the contents in the flask being stirred, in an oil bath for heating. After the flask is held at 48° C. for 80 minutes, 70 parts by weight of the same resin particle dispersion liquid as described above is slowly added into the flask as an additional dosage.

Then, after a pH value inside a system is adjusted to be 6.0 by using a 0.5 mol/L aqueous solution of sodium hydroxide, the flask made of stainless steel is hermetically closed and, thereafter, a seal of a stirring shaft is changed into a magnetic seal and, subsequently, the resultant mixture in the flask is heated to 97° C. with stirring and, then, held at the temperature for 3 hours. After a reaction is complete, the resultant reaction mixture is cooled, filtered, rinsed with a sufficient amount of ion-exchanged water and, then, is subjected to a solid-liquid separation by a Nutche-type suction filtration. The resultant solid component is again dispersed in 3 L of ion-exchanged water at 40° C. The resultant dispersion liquid is stirred at 300 rpm for 5 minutes to allow the resultant solid component to be washed. After such washing operation is repeated 5 times such that a filtrate came to have a pH value of 6.54 and an electric conductivity of 6.4 μS/cm and, then, a solid-liquid separation is performed by using the Nutche-type suction filtration with No. 5 filter paper. Thereafter, the resultant solid component is continuously subjected to a vacuum drying for 12 hours, to thereby obtain a toner 1.

When the volume average particle diameter distribution D50v of the toner 1 is measured by using a Coulter counter, it is 6.2 μm, while the volume average particle size distribution index GSDv is 1.20. When the shape of the toner is observed by using a Luzex image analyzing apparatus (produced by Luzex), it is found that the shape factor SF1 of the particle is 132 and the particle is in a round-edged potato-like shape. When a cross-sectional image of each of 100 sample toners is observed by using a transmission-type electron microscope, the number of domains of releasing agent particles is 3 or more in each of the sample toner particles and is 15 as an average. The releasing agent having a ratio of a major axis to a minor axis of from 5 to 15 occupies 90% or more by number based on the total number thereof, that having a major axis of 1.5 μm or more occupies 40% or more by number based on the total number thereof and that having a major axis of 1.0 μm or more occupies 80% or more by number based on the total number thereof. Further, the glass transition point of the toner is 51° C.

(Fixing Property Test)

A fixing property test is performed on the prepared toner under conditions as described below. An image is generated by using a modified DocuColor 1250 while adjusting a toner deposit amount to be 0.6 g/m$^2$ and the thus-generated image is developed at a developing rate of 90 mm/sec with a nip width of 6.5 mm by using an external fixing apparatus without an oil supplying apparatus being attached thereto. A fixing temperature is controlled based on a surface temperature of a fixing roll and a preset temperature thereof is determined to be 200° C. Examples 2 to 4 and Comparative Examples 1 to 3 are tested under same conditions as described above.

(Results of Fixing Property Test)

A releasing property tested by the aforementioned fixing apparatus is favorable to find that releasing is performed without any resistance and there occurred no offset at all. Further, when a fixed image is folded by two and, then, opened, no deficit of image is observed and, accordingly, a favorable fixing result is obtained.

Example 2

A toner 2 is obtained in a same manner as in Example 1 except that the releasing agent particle dispersion liquid 2 is used in place of the releasing agent particle dispersion liquid 1 but the parts by weight of the former used is same as those of the latter.

When the volume average particle diameter distribution D50v of the toner 2 is measured by using a Coulter counter, it is 6.1 μm, while the volume average particle size distribution index GSDv is 1.20. When the shape of the toner is observed by using a Luzex image analyzing apparatus (produced by Luzex), it is found that the shape factor SF1 of the particle is 131 and the particle is in a round-edged potato-like shape. When a cross-sectional image of each of 100 sample toners is observed by using a transmission-type electron microscope, the number of domains of releasing agent particles is 3 or more in all of the sample toner particles and is 10 as an average therein. The releasing agent having a ratio of a major axis to a minor axis of from 5 to 15 occupies 90% or more by number based on the total number thereof, that having a major axis of 1.5 μm or more occupies 40% or more by number based on the total number thereof and that having a major axis of 1.0 μm or more occupies 80% or more by number based on the total number thereof. Further, the glass transition point of the toner is 51° C.

(Results of Fixing Property Test)

A releasing property tested by the aforementioned fixing apparatus is favorable to find that releasing is performed without any resistance and there occurred no offset at all. Further, when a fixed image is folded by two and, then, opened, no deficit of image is observed and, accordingly, a favorable fixing result is obtained.

Example 3

A toner 3 is obtained in a same manner as in Example 1 except that the releasing agent particle dispersion liquid 3 is used in place of the releasing agent particle dispersion liquid 1 but the parts by weight of the former used is same as those of the latter.

When the volume average particle diameter distribution D50v of the toner 3 is measured by using a Coulter counter, it is 6.1 μm, while the volume average particle size distribution index GSDv is 1.20. When the shape of the toner is observed by using a Luzex image analyzing apparatus (produced by Luzex), it is found that the shape factor SF1 of the particle is 130 and the particle is in a round-edged potato-like shape. When a cross-sectional image of each of 100 sample toners is observed by using a transmission-type electron microscope, the number of domains of releasing agent particles is 3 or more in all of the sample toner particles and is 15 as an average therein. The releasing agent having a ratio of a major axis to a minor axis of from 5 to 15 occupies 90% or more by number based on the total number thereof, that having a major axis of 1.5 μm or more occupies 40% or more by number based on the total number thereof and that having a major axis of 1.0 μm or more occupies 80% or more by number based on the total number thereof. Further, the glass transition point of the toner is 51° C.

(Results of Fixing Property Test)

A releasing property tested by the aforementioned fixing apparatus is favorable to find that releasing is performed without any resistance and there occurred no offset at all. Further, when a fixed image is folded by two and, then, opened, no deficit of image is observed and, accordingly, a favorable fixing result is obtained.

Example 4

A toner 4 is obtained in a same manner as in Example 1 except that the releasing agent particle dispersion liquid 4 is used in place of the releasing agent particle dispersion liquid 1 but the parts by weight of the former used is same as those of the latter.

When the volume average particle diameter distribution D50v of the toner 4 is measured by using a Coulter counter, it is 5.9 μm, while the volume average particle size distribution index GSDv is 1.21. When the shape of the toner is observed by using a Luzex image analyzing apparatus (produced by Luzex), it is found that the shape factor SF1 of the particle is 135 and the particle is in a round-edged potato-like shape. When a cross-sectional image of each of 100 sample toners is observed by using a transmission-type electron microscope, the number of domains of releasing agent particles is 3 or more in all of the sample toner particles and is 18 as an average therein. The releasing agent having a ratio of a major axis to a minor axis of from 5 to 15 occupies 90% or more by number based on the total number thereof, that having a major axis of 1.5 μm or more occupies 40% or more by number based on the total number thereof and that having a major axis of 1.0 μm or more occupies 80% or more by number based on the total number thereof. Further, the glass transition point of the toner is 52° C.

(Results of Fixing Property Test)

Although a releasing property tested by the aforementioned fixing apparatus is favorable, a slight resistance is observed at the time of releasing. There occurred no offset at all. The image is found favorable without having an uneven portion or the like. Further, when a fixed image is folded by two and, then, opened, no deficit of image is observed and, accordingly, a favorable fixing result is obtained.

Comparative Example 1

A toner 5 is obtained in a same manner as in Example 1 except that the releasing agent particle dispersion liquid 5 is used in place of the releasing agent particle dispersion liquid 1 but the parts by weight of the former used is same as those of the latter.

When the volume average particle diameter distribution D50v of the toner 5 is measured by using a Coulter counter, it is 5.8 μm, while the volume average particle size distribution index GSDv is 1.20. When the shape of the toner is observed by using a Luzex image analyzing apparatus (produced by Luzex), it is found that the shape factor SF1 of the particle is 130 and the particle is in a round-edged potato-like shape. When a cross-sectional image of each of 100 sample toners is observed by using a transmission-type electron microscope, the number of domains of releasing agent particles is high in a range of from 1 to 5 and is 3 as an average. The releasing agent having a ratio of a major axis to a minor axis of 5 or less occupies 50% by number based on the total number thereof, that having a major axis of 1.5 μm or more occupies 40% or more by number based on the total number thereof and that having a major axis of 1.0 μm or more occupies 80% or more by number based on the total number thereof. Further, the glass transition point of the toner is 48° C.

(Results of Fixing Property Test)

A releasing property tested by the aforementioned fixing apparatus is favorable. It is confirmed that releasing is performed without any resistance, but an offset occurred. Further, when a fixed image is folded by two and, then, opened, no deficit of image is observed, but it is observed than the fixing property is unfavorable.

Comparative Example 2

A toner 6 is obtained in a same manner as in Example 1 except that the releasing agent particle dispersion liquid 6 is used in place of the releasing agent particle dispersion liquid 1 but the parts by weight of the former used is same as those of the latter.

When the volume average particle diameter distribution D50v of the toner 6 is measured by using a Coulter counter, it is 6.5 μm, while the volume average particle size distribution index GSDv is 1.21. When the shape of the toner is observed by using a Luzex image analyzing apparatus (produced by Luzex), it is found that the shape factor SF1 of the particle is 132 and the particle is in a round-edged potato-like shape. When a cross-sectional image of each of 100 sample toners is observed by using a transmission-type electron microscope, the number of domains of releasing agent particles is 3 or more in all of the sample toners and is 12 as an average therein. The releasing agent having a ratio of a major axis to a minor axis of from 5 to 15 occupies 90% by number based on the total number thereof, that having a major axis of 1.5 μm or more occupies 40% or more by number based on the total number thereof and that having a major axis of 1.0 μm or more occupies 80% or more by number based on the total number thereof. Further, the glass transition point of the toner is 51° C.

(Results of Fixing Property Test)

A releasing property tested by the aforementioned fixing apparatus is unfavorable. An uneven portion caused by inferior releasing at the time of discharging is generated on a surface of an image. Further, an offset occurred. When a fixed image is folded by two and, then, opened, no deficit of image is observed, but it is observed than the fixing property is unfavorable.

Comparative Example 3

A toner 7 is obtained in a same manner as in Example 1 except that the releasing agent particle dispersion liquid 7 is used in place of the releasing agent particle dispersion liquid 1 but the parts by weight of the former used is same as those of the latter.

When the volume average particle diameter distribution D50v of the toner 7 is measured by using a Coulter counter, it is 6.0 μm, while the volume average particle size distribution index GSDv is 1.20. When the shape of the toner is observed by using a Luzex image analyzing apparatus (produced by Luzex), it is found that the shape factor SF1 of the particle is 136 and the particle is in a round-edged potato-like shape. When a cross-sectional image of each of 100 sample toners is observed by using a transmission-type electron microscope, the number of domains of releasing agent particles is 3 or more in all of the sample toners and is 18 as an average therein. The releasing agent having a ratio of a major axis to a minor axis of from 5 to 15 occupies 90% by number based on the total number thereof, that having a major axis of 1.5 μm or more occupies 30% by number based on the total number thereof and that having a major axis of 1.0 μm or more occupies 60% by number based on the total number thereof. Further, the glass transition point of the toner is 52° C.

(Results of Fixing Property Test)

A releasing property tested by the aforementioned fixing apparatus is unfavorable. An uneven portion caused by inferior releasing at the time of discharging is generated on a surface of an image. Further, an offset occurred. When a fixed image is folded by two and, then, opened, no deficit of image is observed, but it is observed than the fixing property is unfavorable.

The results of Examples 1 to 4 and Comparative Examples 1 to 3 are shown in Table 2.

TABLE 2

| | Toner | Volume average particle diameter D50v (μm) | Volume average particle size distribution index GSDv | Shape factor SF1 | Average domain number | Major axis/minor axis (5 to 15) (number %) | Major axis >1.5 μm (number %) | Major axis >1.0 μm (number %) | Glass transition point ° C. | Releasing property | Fixing property |
|---|---|---|---|---|---|---|---|---|---|---|---|
| Example 1 | 1 | 6.2 | 1.20 | 132 | 15 | >90 | >40 | >80 | 51 | Favorable | Favorable |
| Example 2 | 2 | 6.1 | 1.20 | 131 | 10 | >90 | >40 | >80 | 51 | Favorable | Favorable |
| Example 3 | 3 | 6.1 | 1.20 | 130 | 15 | >90 | >40 | >80 | 51 | Favorable | Favorable |
| Example 4 | 4 | 5.9 | 1.21 | 135 | 18 | >90 | >40 | >80 | 52 | Favorable | Favorable |
| Comparative Example 1 | 5 | 5.8 | 1.20 | 130 | 3 | <50 | >40 | >80 | 48 | Favorable | Unfavorable |
| Comparative Example 2 | 6 | 6.5 | 1.21 | 132 | 12 | >90 | >40 | >80 | 51 | Unfavorable | Unfavorable |
| Comparative Example 3 | 7 | 6.0 | 1.20 | 136 | 18 | >90 | 30 | 60 | 52 | Unfavorable | Unfavorable |

What is claimed is:

1. An electrophotographic toner comprising□ a resin;

a colorant; and a releasing agent, wherein:

the releasing agent has a solidifying point of from 79° C. to 109° C., the releasing agent has one peak in an endothermic curve measured by a differential scanning calorimeter, a difference between a temperature to give a maximum endothermic peak of the releasing agent and an end-set temperature of the releasing agent is within 10° C., a melt viscosity of the releasing agent at 110° C. is in a range of from 4 mPa·s to 9 mPa·s, the releasing agent in one particle of the toner forms 3 or more domains, the domains include domains having a ratio of a major axis to a minor axis in a range of from 5 to 15 which occupy equal to or more than 90% by number based on the total number of domains, the domains include domains having a major axis of 1.5 μm or more which occupy equal to or more than 40% by number based on the total number of domains, and the domains include domains having 1.0 μm or more which occupy equal to or more than 80% by number based on the total number of domains.

2. The electrophotographic toner according to claim 1, wherein the releasing agent is a paraffin-type wax, a ratio of an isoparaffin to an n-paraffin in the releasing agent is in a range of from 4% to 10% by weight, and a penetration degree of the releasing agent at 25° C. is equal to or less than 5.

3. The electrophotographic toner according to claim 1, wherein a ratio of a melt viscosity of the releasing agent to a melt velocity of the resin at 180° C. is in a range of from $1.0\times10^{-4}$ to $3.0\times10^{-4}$.

4. The electrophotographic toner according to claim 1, wherein a content of the releasing agent in the toner is in a range of from 5 to 13% by weight based on the total solid content of the toner.

5. The electrophotographic toner according to claim 1, wherein an acid value of the toner is in a range of from 10 mg·KOH/g to 50 mg·KOH/g.

6. The electrophotographic toner according to claim 1, wherein a volume average particle diameter D50v of the toner is in a range of from 3 μm to 9 μm, a volume average particle size distribution index GSDv is equal to or less than 1.30, and the volume average particle size distribution index GSDv is defined by $$GSDv=(D84v/D16v)$$

where D50v, D84v and D16v each represents a volume average particle diameter showing 50%, 84% and 16% of accumulation when a cumulative distribution curve of volume in divided particle size ranges is constructed starting from a side of smaller diameter.

7. The electrophotographic toner according to claim 1, wherein the toner has a shape factor SF1 of from 110 to 140 and the shape factor SF1 is defined by $$SF1=(ML^2/A)\times(\pi/4)\times100$$

where ML represents a maximum length of the toner, and A represents a projected area of the toner.

* * * * *